US009277601B2

(12) United States Patent
Bandholz et al.

(10) Patent No.: US 9,277,601 B2
(45) Date of Patent: Mar. 1, 2016

(54) OPERATING AN APPLIANCE BASED ON COOKING INSTRUCTIONS EMBEDDED IN AN RFID PRODUCT TAG

(75) Inventors: Justin P. Bandholz, Cary, NC (US); Joseph E. Maxwell, Cary, NC (US); Pravin Patel, Cary, NC (US); Phillip L. Weinstein, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 1957 days.

(21) Appl. No.: 12/393,614

(22) Filed: Feb. 26, 2009

(65) Prior Publication Data

US 2010/0213187 A1 Aug. 26, 2010

(51) Int. Cl.
*H05B 1/02* (2006.01)
*H05B 6/64* (2006.01)

(52) U.S. Cl.
CPC ..... *H05B 6/6441* (2013.01)

(58) Field of Classification Search
CPC ..... H05B 6/6441
USPC ..... 219/506, 494, 620; 99/285, 326
See application file for complete search history.

(56) References Cited

U.S. PATENT DOCUMENTS

| | | | | |
|---|---|---|---|---|
| 6,232,585 | B1 * | 5/2001 | Clothier et al. | 219/620 |
| 6,316,753 | B2 * | 11/2001 | Clothier et al. | 219/621 |
| 6,320,169 | B1 * | 11/2001 | Clothier | 219/626 |
| 6,664,520 | B2 * | 12/2003 | Clothier | 219/634 |
| 6,676,014 | B2 * | 1/2004 | Catan | 235/375 |
| 6,758,397 | B2 * | 7/2004 | Catan | 235/385 |
| 6,953,919 | B2 * | 10/2005 | Clothier | 219/620 |
| 7,080,593 | B1 * | 7/2006 | Frankel | 99/326 |
| 7,205,016 | B2 * | 4/2007 | Garwood | 426/108 |
| 7,223,427 | B2 * | 5/2007 | Knepler | 426/231 |
| 7,355,150 | B2 * | 4/2008 | Baarman et al. | 219/620 |
| 7,372,003 | B2 * | 5/2008 | Kates | 219/494 |
| 2002/0143643 | A1 * | 10/2002 | Catan | 705/26 |
| 2002/0143860 | A1 * | 10/2002 | Catan | 709/203 |
| 2003/0170357 | A1 * | 9/2003 | Garwood | 426/392 |
| 2004/0146602 | A1 * | 7/2004 | Garwood et al. | 426/35 |

(Continued)

FOREIGN PATENT DOCUMENTS

| | | | |
|---|---|---|---|
| WO | WO2007082172 | A2 | 7/2007 |
| WO | WO2007082172 | A3 | 7/2007 |

OTHER PUBLICATIONS

Tsai, Ming; Panko-Crusted Butter Fish with Wasabi-Avocado Crema and Mango; 2012.*

*Primary Examiner* — Phuong Nguyen
(74) *Attorney, Agent, or Firm* — Jeffrey L. Streets

(57) ABSTRACT

Method and computer program product for using an RFID antenna of a cooking appliance to read a plurality of cooking instruction sets from a single RFID tag associated with a food product that is positioned to be cooked by the cooking appliance. The cooking appliance selects one of the plurality of cooking instruction sets that the cooking appliance is capable of performing. Furthermore, the cooking appliance may then automatically cook the food product by controlling the cooking appliance according to the selected cooking instruction set. The selection of a cooking instruction set may consider the temperature of the food product or a determination whether the food product is frozen. Alternatively, cooking appliance settings may be interpolated between two cooking instruction sets or calculated on the basis of physical property information about the food product.

11 Claims, 6 Drawing Sheets

(56) References Cited

U.S. PATENT DOCUMENTS

| | | | | |
|---|---|---|---|---|
| 2004/0149736 | A1 | 8/2004 | Clothier | |
| 2005/0208188 | A1* | 9/2005 | Garwood | 426/392 |
| 2006/0081653 | A1* | 4/2006 | Boland et al. | 222/243 |
| 2006/0144244 | A1* | 7/2006 | Girard et al. | 99/295 |
| 2007/0062379 | A1* | 3/2007 | Pardoe et al. | 99/331 |
| 2007/0068393 | A1* | 3/2007 | Nosler et al. | 99/279 |
| 2007/0144202 | A1 | 6/2007 | Theodos et al. | |
| 2007/0145034 | A1* | 6/2007 | Imura | 219/494 |
| 2007/0292559 | A1* | 12/2007 | Garwood | 426/2 |
| 2008/0037232 | A1* | 2/2008 | Schroetlin | 361/760 |
| 2008/0083338 | A1* | 4/2008 | Niemetz | 99/326 |
| 2008/0094220 | A1* | 4/2008 | Foley et al. | 340/572.4 |
| 2008/0102175 | A1* | 5/2008 | Jeon et al. | 426/233 |

* cited by examiner

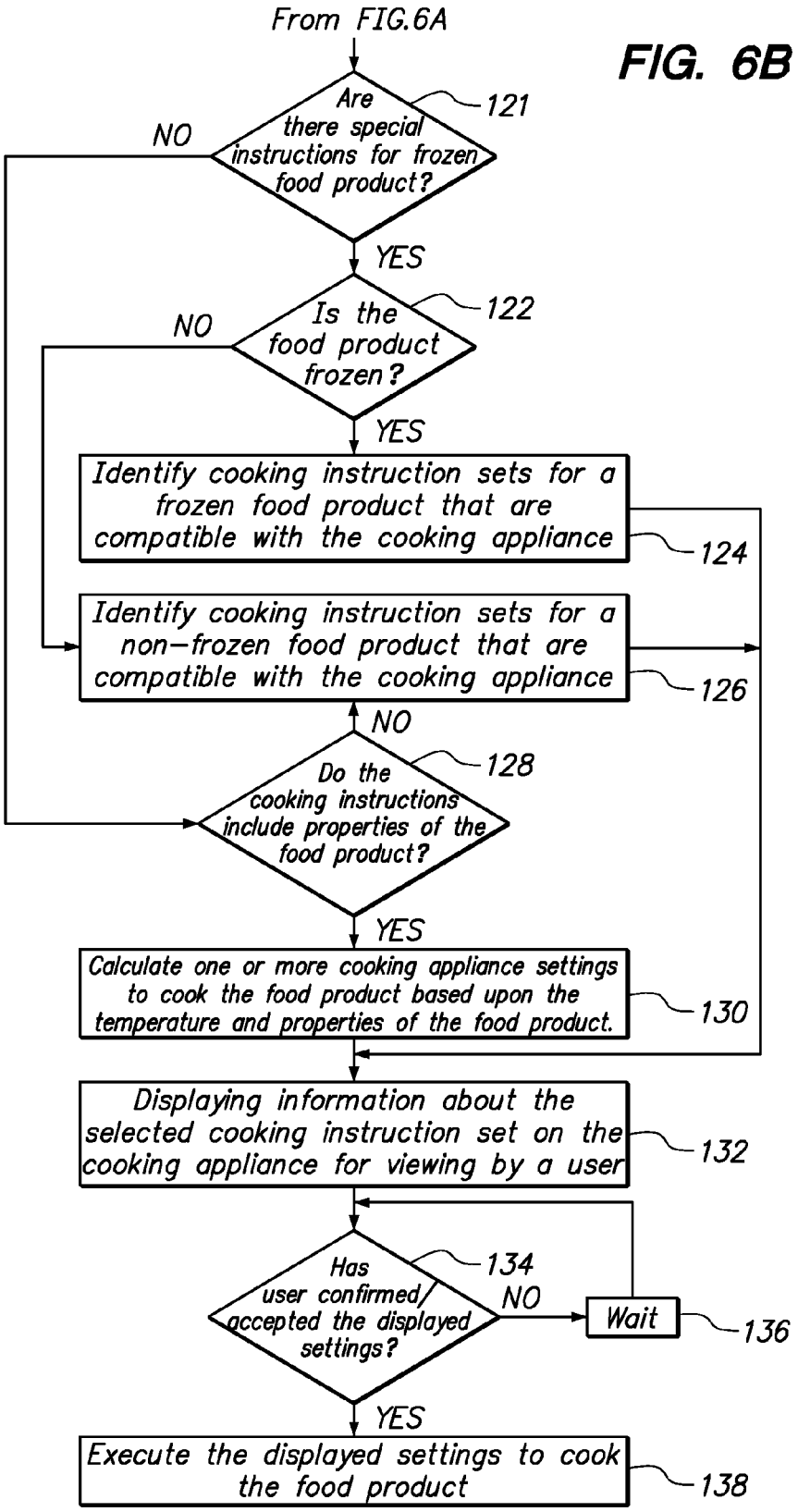
From FIG.6A
FIG. 6B
Are there special instructions for frozen food product?
121
NO
YES
Is the food product frozen?
122
NO
YES
Identify cooking instruction sets for a frozen food product that are compatible with the cooking appliance
124
Identify cooking instruction sets for a non-frozen food product that are compatible with the cooking appliance
126
NO
Do the cooking instructions include properties of the food product?
128
YES
Calculate one or more cooking appliance settings to cook the food product based upon the temperature and properties of the food product.
130
Displaying information about the selected cooking instruction set on the cooking appliance for viewing by a user
132
Has user confirmed/accepted the displayed settings?
134
NO
Wait
136
YES
Execute the displayed settings to cook the food product
138

OPERATING AN APPLIANCE BASED ON COOKING INSTRUCTIONS EMBEDDED IN AN RFID PRODUCT TAG

BACKGROUND OF THE INVENTION

1. Field of the Invention

The present invention relates to devices and systems for cooking food.

2. Background of the Related Art

Cooking food on a stovetop or in a conventional or microwave oven typically requires that a user manually adjust power or temperature settings in accordance with a set of printed instructions. Even modern cooking appliances, which may include the capability of being programmed to perform various cooking steps, typically require manual entry of every program detail. The manual entry of settings and programs must be made in every instance that the appliance is used. Because the content of pre-packaged food items is generally consistent, the repetitive entry of settings and programs for a given food item can itself become time consuming and annoying.

U.S. Pat. No. 6,953,919 discloses a system and method for automatically heating a cooking vessel using radio frequency identification (RFID) technology. An RFID tag and a temperature sensor are included with the vessel so that the vessel temperature and heating information within the RFID tag may be read by an RFID antenna that is coupled to a microprocessor within part of a cooking appliance. The temperature and heating information is downloaded into the microprocessor for use in heating the vessel.

BRIEF SUMMARY OF THE INVENTION

One embodiment of the present invention provides a computer program product including computer usable program code embodied on a computer usable medium for operating a cooking appliance. The computer program product comprises computer usable program code for using an RFID antennae of a cooking appliance to read a plurality of cooking instruction sets from a single RFID tag associated with a food product that is positioned to be cooked by the cooking appliance, computer usable program code for selecting one of the plurality of cooking instruction sets that the cooking appliance is capable of performing, and computer usable program code for cooking the food product by controlling the cooking appliance according to the selected cooking instruction set.

Another embodiment of the invention provides a method that comprises using an RFID antenna of a cooking appliance to read a plurality of cooking instruction sets from a single RFID tag associated with a food product that is positioned to be cooked by the cooking appliance. One of the plurality of cooking instruction sets that the cooking appliance is capable of performing is then automatically selected and the food product is cooked by controlling the cooking appliance according to the selected cooking instruction set.

BRIEF DESCRIPTION OF THE SEVERAL VIEWS OF THE DRAWINGS

FIGS. 6A-6B provide a flowchart of a detailed method by which a cooking appliance may automatically select among a plurality of cooking instruction sets.

DETAILED DESCRIPTION OF THE INVENTION

Figure 1A:
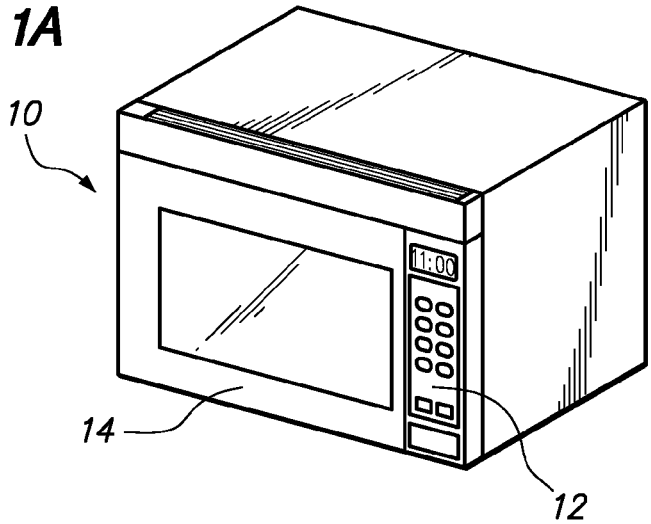
FIGS. 1A-C are perspective views of three exemplary types of cooking appliances in which the present invention may be implemented.

One embodiment of the present invention provides a computer program product including computer usable program code embodied on a computer usable medium for operating a cooking appliance. The computer program product comprises computer usable program code for using an RFID antenna of a cooking appliance to read a plurality of cooking instruction sets from a single RFID tag associated with a food product that is positioned to be cooked by the cooking appliance. The computer usable program code may select one of the plurality of cooking instruction sets that the cooking appliance is capable of performing and cooking the food product by controlling the cooking appliance according to the selected cooking instruction set.

In a further embodiment, each cooking instruction set stored in the RFID tag includes a cooking appliance performance parameter value necessary to perform the cooking instruction set. For example, one set of cooking instructions may be intended for a microwave oven having 1000 Watts of power. This cooking instruction set will include a quantitative cooking appliance performance parameter of 1000 Watts, along with a cooking duration (generally in minutes and seconds) and a power level (generally 0 to 10). Only a microwave capable of delivering the power required by the instruction set should use this set of instructions. A further set of cooking instructions may include duration and temperature settings as well as a qualitative cooking appliance performance parameter, such as "convection" in order to be applicable only to convection ovens that typically cook food faster and more evenly. Accordingly, only a convection oven should select this further set of cooking instructions for use in cooking the food product.

Preferably, the cooking appliance selects the cooking instruction set that most closely matches the capabilities of the appliance. If none of the instructions are a good match, the appliance can derive cook settings from the food properties, as described above, or alter a cooking instruction set for the current package temperature. For example, the cooking appliance may utilize one or more of the cooking instruction sets in order to determine optimal cooking setting. Specifically, if the RFID tag includes instructions for a 500 W and 1000 W microwave oven but the microwave oven cooking appliance has a performance parameter rating of 800 W, then microwave will interpolate between the two given cooking instruction sets to determine the optimal settings for cooking the food product.

Optionally, the computer usable program code reads a performance parameter rating of the cooking appliance from a memory device of the cooking appliance. Because the performance parameter rating of the cooking appliance is a function of its manufactured components, this rating is never expected to change and should be stored in a non-volatile memory device that need not include any re-write capability. By determining whether the performance parameter rating of the cooking appliance is greater than or equal to the performance parameter value of the cooking instruction set, the computer usable program code identifies which of the plurality of cooking instructions the cooking appliance is capable of performing.

In another embodiment, the RFID tag is secured to packaging that holds the food product. The packaging may directly contact the edible food product, such as a soup bowl, or the packaging may simple contain the edible food product, such as a cardboard box securing a cooking-safe container that itself includes the edible food product. The exact type or combination of packaging, as well as the type(s) of cooking appliance recommended for cooking the food product, will vary from one food product to another. However, it is preferably that an RFID tag be provided with each package of the food product in order to facilitate automatic selection of a cooking instruction set for cooking of the food product in that package.

Furthermore, it is convenient for the RFID tag to be secured to packaging that will accompany the food product into a cooking zone of the cooking appliance. In this manner, an RFID scanner may be disposed to establish a reading zone that overlaps or coincides with the cooking zone so that it is possible to read the RFID tag of any food product that is going to be cooked by the appliance. Alternatively, the RFID scanner may establish a separate reading zone, requiring the user to pass the RFID tag through the reading zone prior to placing the food product into the cooking zone. In yet another alternative, the RFID tag may be detachable from the packaging so that the user can handle the RFID tag separately from the food product and pass the RFID tag through the reading zone before, during or after placing the food product into the cooking zone. It is generally not necessary for the RFID tag to remain in the cooking zone during the cooking process, unless additional or updated temperature readings or cooking instructions are needed.

In an additional embodiment, the RFID tag is able to communicate a temperature of the food product when the RFID antenna of the cooking appliance reads the RFID tag. This enables the computer usable program code to adjust a predetermined set of cooking instructions based upon the temperature of the food product. Preferably, the temperature of the food product is read by the cooking appliance prior to cooking the food product, and the temperature is considered in adjusting the cooking instruction set that will be used to the cook the food. Optionally, there is no need to scan the RFID tag to obtain additional temperature readings. However, at least one additional temperature reading may be made, for example to assure that the cooking continues until a desired temperature prescribed in the selected cooking instruction set is reached.

In an alternative to the foregoing embodiment, the temperature of the food product may be read to enable a determination whether the food product is frozen or not frozen. Accordingly, the computer usable program code may select a first cooking instruction set in response to determining that the food product is frozen, and a second cooking instruction set in response to determining that the food product is not frozen. A frozen food product will require more cooking than an identical food product that has already thawed. Furthermore, a cooking instruction set for a food product that is frozen may include a preliminary cooking step to defrost the food using a low power setting prior to a secondary cooking step at a higher power setting.

In a still further embodiment, the cooking instructions may include physical properties of the food product, such that the computer usable program code may automatically calculate one or more cooking appliance settings to cook the food product based upon the physical properties of the food product. For example, the physical properties of the food product may include the mass, water content, and dimensions. Where the cooking appliance is a microwave oven, these physical properties may provide the input for calculating one or more cooking appliance settings, such as a power level and duration. Preferably, the computer usable program code causes information about the selected cooking instruction set to be displayed on the cooking appliance for viewing by a user, and initiates a cooking step upon detecting user confirmation of the displayed information. In one alternative where the cooking appliance is an oven, the computer usable program code may begin the cooking step upon detecting that a door of the oven has been closed with the food product inside.

Another embodiment of the invention provides a method that comprises using an RFID antenna of a cooking appliance to read a plurality of cooking instruction sets from a single RFID tag associated with a food product that is positioned to be cooked by the cooking appliance. One of the plurality of cooking instruction sets that the cooking appliance is capable of performing is then automatically selected and the food product is cooked by controlling the cooking appliance according to the selected cooking instruction set. Additional aspect of the foregoing computer program product may be implemented in solely with hardware or in a combination of hardware and software.

It should be recognized that the food supplier provides the RFID tag with predetermined cooking instruction sets for multiple different cooking appliances (different power microwaves, ovens, etc) and starting temperatures. The cooking instruction sets may include not only power levels, cooking duration, measured humidity, and food temperature, but may also include human intervention instructions. Examples of human intervention instructions include turning the food product over, stirring the food product, and the like. Additionally, the supplier may provide the RFID tag with the physical properties of the food product, such as thermal mass, conductivity, water content and/or susceptibility to microwaves. The supplier encodes these cooking instruction sets and other information into a common structure and stores it on the RFID tag.

Figure 1B:
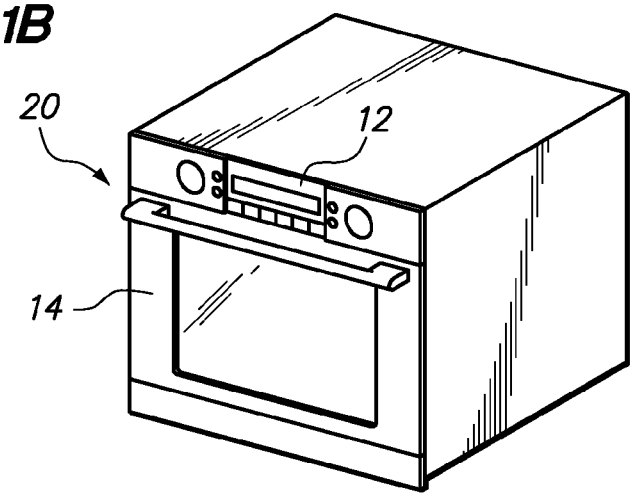
Figure 1C:
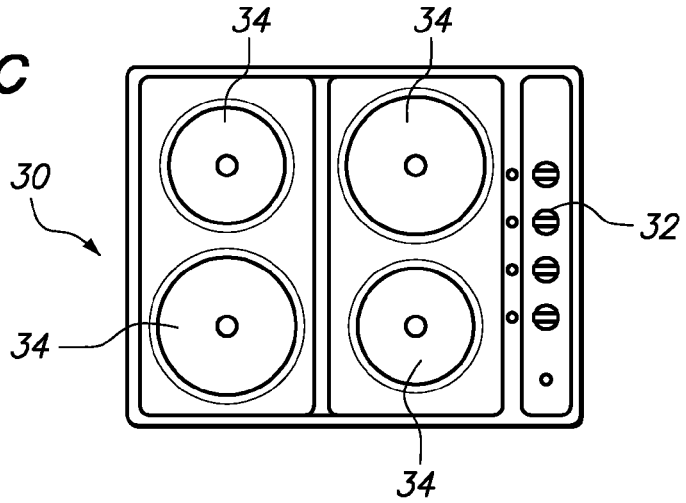

FIGS. 1A-C are perspective views of three exemplary types of cooking appliances in which the present invention may be implemented. FIG. 1A shows a typical configuration of a microwave oven 10 having a control panel 12 and a door 14 that opens to a cooking zone that receives a food product. FIG. 1B shows a typical configuration of a conventional oven 20 having a control panel 22 and a door 24 that opens to a cooking zone that receives a food product. FIG. 1C shows a typical stovetop 30, also known as a range, having a control panel 32 and a plurality of heating elements 34 that each define a cooking zone that may receive a food product.

Figure 2:
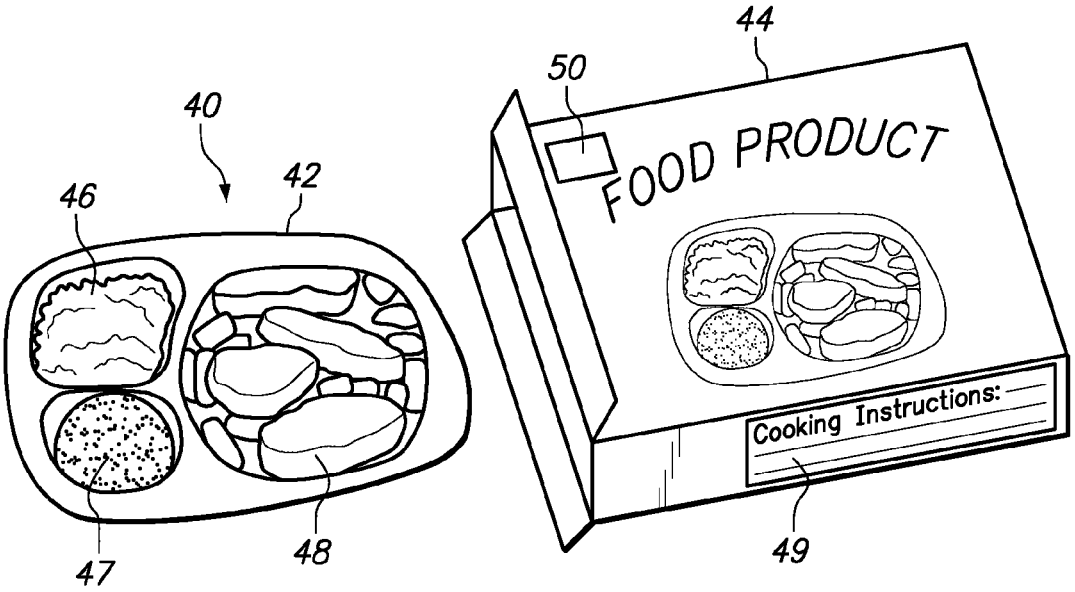
FIG. 2 is a perspective view of a food product that has been removed from its packaging.

FIG. 2 is a perspective view of an edible food product 40 contained in primary packaging 42 that has been removed from its secondary packaging 44. The edible food product 40 is shown here as a prepackaged, ready-to-eat meal, known to some as a "TV dinner," that includes individual food items 46, 47, 48. In accordance with the present invention, it may not be necessary to remove the primary packaging 42 from the secondary packaging 44 before cooking. Rather, the methods of the present invention may be utilized so that food product is cooked according to a cooking instruction set provided by the food product manufacturer. As shown, the secondary packaging 44 includes a standard set of written cooking instructions 49 that enable a user to manually program or enter settings into a cooking appliance. However, the secondary packaging 44 also includes an RFID tag 50 that is capable of communicating a plurality of cooking instruction sets to an RFID scanner. It should be appreciated that the RFID tag 50 may also be secured to the primary packaging 42 or otherwise provided along with the food product.

Figure 3:
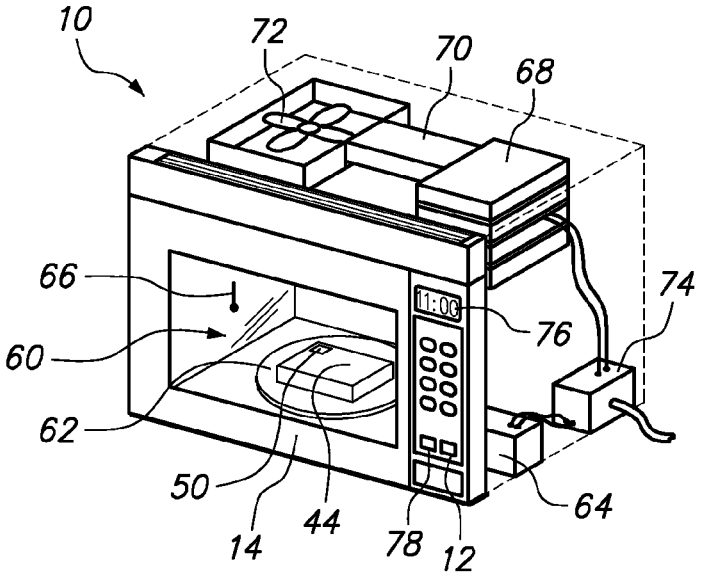
FIG. 3 is a schematic diagram of a microwave oven containing the food product inside its packaging.

FIG. 3 is a schematic diagram of the microwave oven 10 containing the food product inside its packaging 44. A cooking zone or chamber 60 is bounded by the inside walls and the door 14 of the microwave. The package 44 containing the food product typically sits on a tray or turntable 62 that is controllable by a controller 64. An RFID scanner 66 is provided to establish a reading zone that coincides with the cooking zone 60 in order to read the RFID tag 50 throughout most of the zone 60. Therefore, it is not necessary for the user to manually enter a power level and cooking duration into the control panel 12. After the controller 64 receives the cooking instruction sets from the RFID tag 50, the controller 64 may select one of the cooking instruction sets and begin cooking.

The microwaves are produced by a magnetron 68 and pass through a wave guide 70 to a fan or "stirrer" 72 that directs the microwaves throughout the cooking zone 60. A transformer 74 provides appropriate AC or DC voltage levels to the magnetron 68, the controller 64 and the display 76, as well as other electrical components of the microwave 10. According to certain embodiments, a designated confirmation button, such as a start button 78, is pushed by a user in order to confirm the displayed cooking instruction set and cause the microwave cooking appliance to being cooking the food product.

Figure 4:
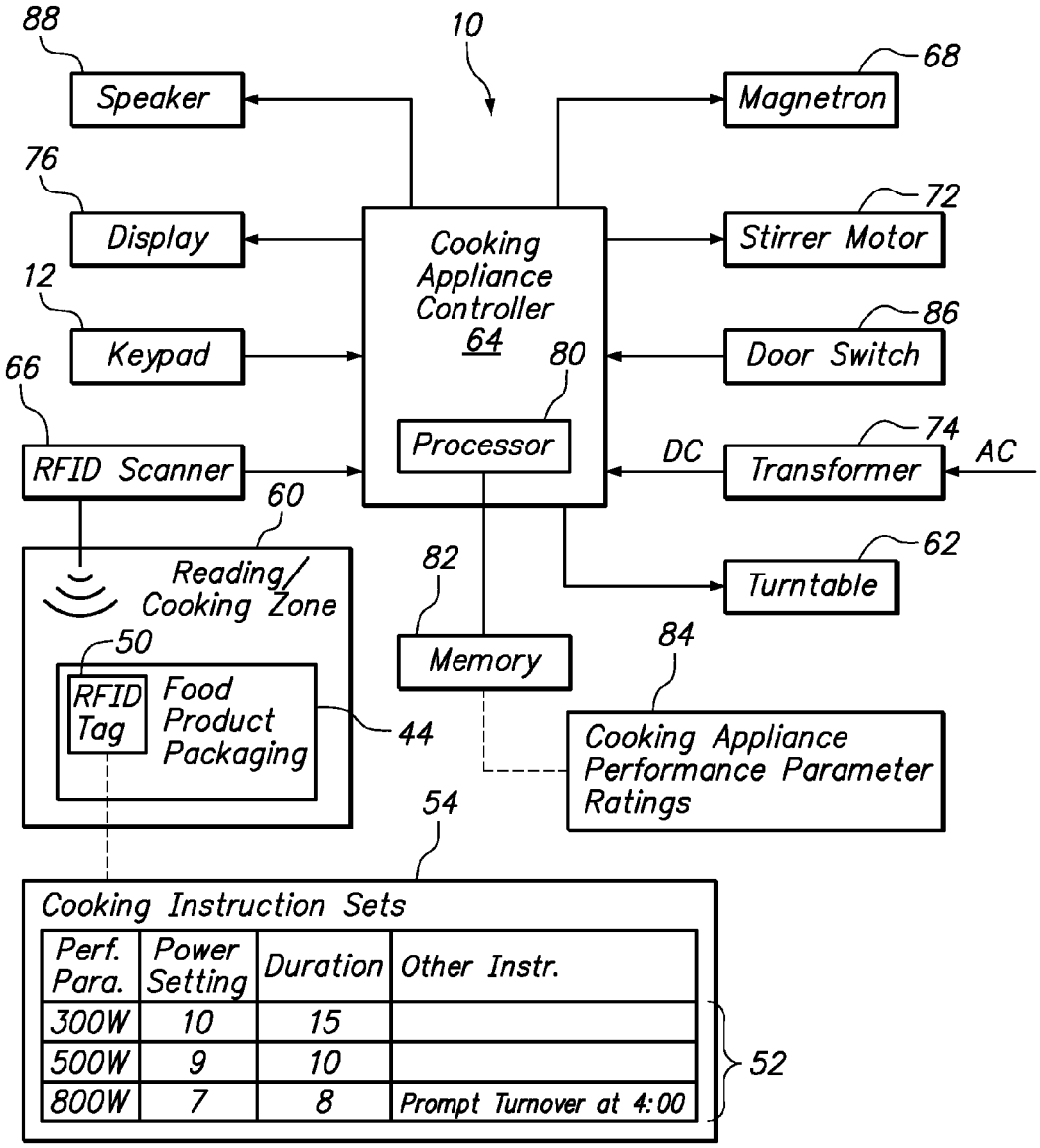
FIG. 4 is a block diagram of a cooking appliance having an RFID scanner in communication with a RFID tag on a food product.

FIG. 4 is a block diagram of the cooking appliance 10 having the RFID scanner 66 in communication with the RFID tag 50 on the food product packaging 44. The RFID tag 50 contains a plurality of cooking instruction sets 52 in a data structure 54. The cooking appliance is operated by a cooking appliance controller 64, which preferably includes a processor 80 for executing a computer program product comprising computer useable program code. The processor 80 communicates with memory 82, which stores at least one cooking appliance performance rating 84. In this manner, the processor 80 gains access to both the cooking instruction sets 52 and the cooking appliance performance parameter ratings 84 and may identify an appropriate cooking instruction set for the cooking appliance having the given ratings 84.

The remainder of the components in the microwave oven cooking appliance 10 is generally standard equipment in a modern microwave oven. Namely, a keypad 12 and door switch 86 provide input to the controller 64. Conversely, the controller provides output to the visual display 76, a speaker 88, and the turntable 62, and causes the sends microwaves throughout the cooking zone using the magnetron 68 and the stirrer motor 72. A typical residential or commercial AC grid may supply AC electrical current to the appliance and those components requiring DC current are provided with the output of a transformed 74.

Figure 5:
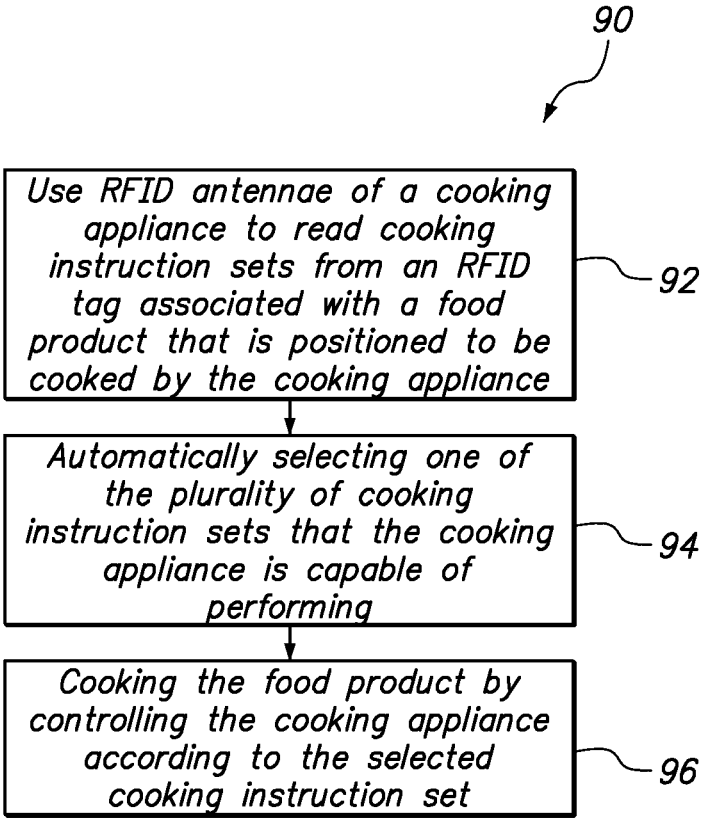
FIG. 5 is a flowchart of a method of reading cooking instruction sets and cooking the food product by controlling the cooking appliance according to a selected cooking instruction set.

FIG. 5 is a flowchart of a method 90 of reading cooking instruction sets and cooking the food product by controlling the cooking appliance according to a selected cooking instruction set. In step 92, an RFID antenna of a cooking appliance is used to read cooking instruction sets from an RFID tag associated with a food product that is positioned to be cooked by the cooking appliance. In step 94, the cooking appliance automatically selects one of the plurality of cooking instruction sets that the cooking appliance is capable of performing. In step 96, the food product is cooked by controlling the cooking appliance according to the selected cooking instruction set.

Figure 6A:
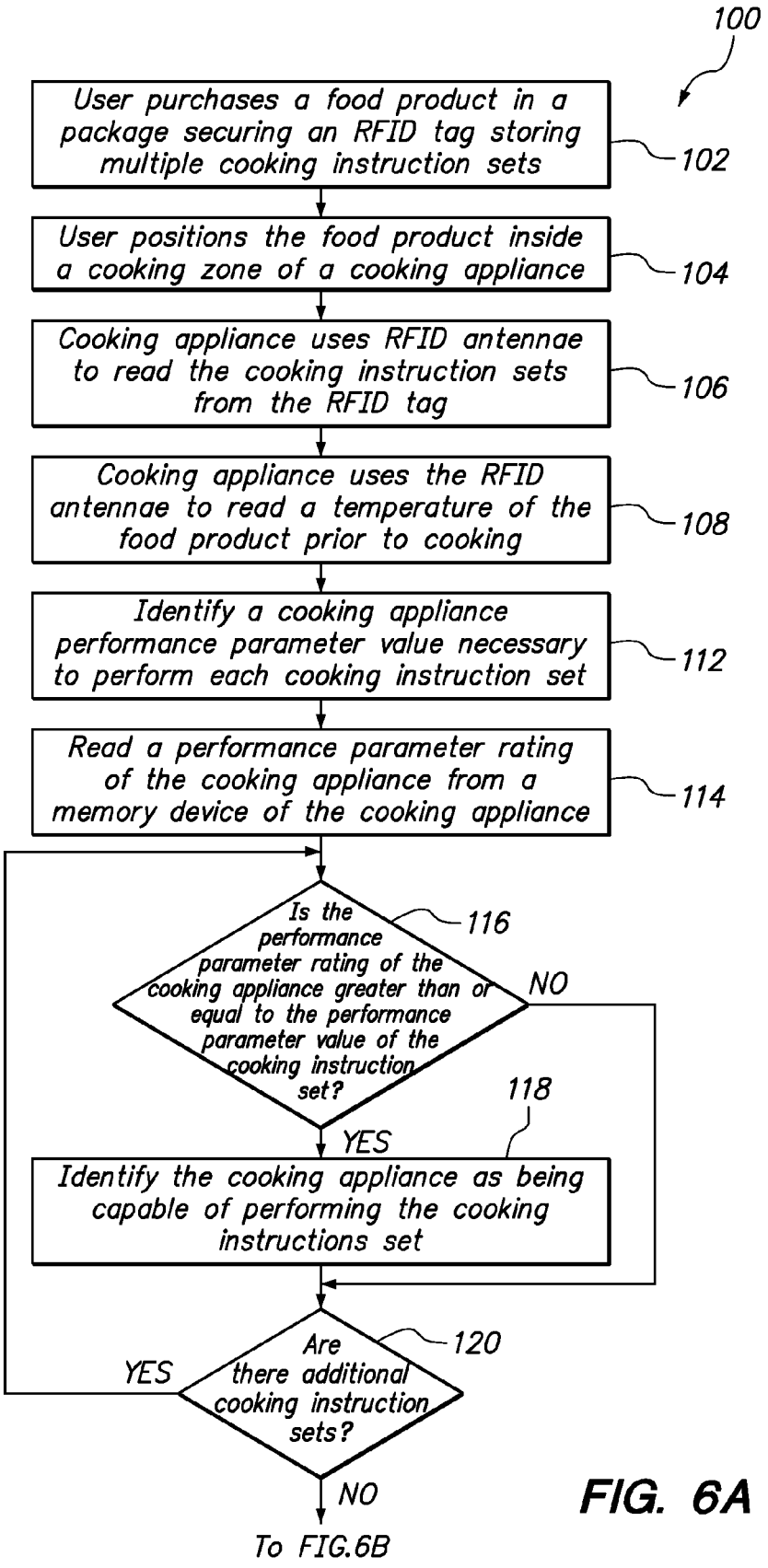

FIGS. 6A-6B provide a flowchart 100 of a detailed method by which a cooking appliance may automatically select among a plurality of cooking instruction sets. According to this embodiment, there are two steps that precede the involvement of the cooking appliance. As a practical matter, a user would first purchase a food product in a package securing an RFID tag storing multiple cooking instruction sets, as described in step 102. Then, in step 104, the user positions the food product inside a cooking zone of the cooking appliance.

In step 106, the cooking appliance uses an RFID antenna to read the cooking instruction sets from the RFID tag. In step 108, the cooking appliance uses the RFID antennae to read a temperature of the food product prior to cooking. The cooking appliance, in step 112, identifies a cooking appliance performance parameter value necessary to perform each cooking instruction set and, in step 114, reads a performance parameter rating of the cooking appliance from a memory device of the cooking appliance. Following these two steps 112, 114, it is determined, in step 116, whether the performance parameter rating of the cooking appliance greater than or equal to the performance parameter value of the cooking instruction set. If the determination in step 116 is affirmative, then in step 118 the cooking appliance is identified as being capable of performing the cooking instructions set before advancing to step 120. Alternatively, if the determination in step 116 is negative, then the method advances directly to step 120. In step 120, if it is determined that there are additional cooking instruction sets, then the process returns to step 116. Once all of the cooking instruction sets have been analyzed relative to the cooking appliance performance parameter rating, then the process continues to step 122 (See FIG. 6B).

In FIG. 6B, step 121 whether the cooking instruction sets include any special cooking instructions for food product that is frozen. If not, then the process advances to step 128. However, if special cooking instructions for frozen food are found, then in step 122 it is determined whether the food product is frozen. If the food product is frozen, then step 124 identifies cooking instruction sets for a frozen food product that are compatible with the cooking appliance. If the food product is not frozen (i.e., it is thawed), then step 126 identifies cooking instruction sets for a non-frozen food product that are compatible with the cooking appliance. After completing either step 124 or 126, the process advances to step 132.

If step 121 determined that there are special cooking instruction sets for frozen food, then step 128 determine whether the cooking instructions include physical properties of the food product. If no physical properties are provided, then the process continues with step 126. However, if physical properties of the food product are provided, then step 130 calculates one or more cooking appliance settings to cook the food product based upon the temperature and properties of the food product.

In step 132, information about the selected cooking instruction set is displayed on the cooking appliance for viewing by a user. If the user has not confirmed/accepted the displayed settings or cooking instruction set in step 134, then there is a wait step 136 before returning to step 134. Upon detecting that the user has confirmed/accepted the displayed settings or cooking instruction set, the process advances to step 138, where the cooking appliance executed the displayed settings to cook the food product.

Generally, the term "RF" is used herein to include any electromagnetic field from very low frequency (e.g., RF used for communication between submarines) to Gamma rays, which are forms of electromagnetic radiation (EMR) or light emissions of a specific frequency produced from sub-atomic particle interaction, such as electron-positron annihilation and radioactive decay. RF can be largely distinguished according to its frequency. For example, light is a form of RF at a wavelength that it is detectable to the human eye. One skilled in the art might use the term RF to describe a range of frequencies that typically penetrate solid objects so the field itself is not blocked (or attenuated). There are practical limits and considerations, however, to which types and frequencies of RF may be selected for use in this embodiment. For example, the RF generated radioactively by plutonium could be used to implement the invention, but the radiation produced by plutonium is really a very high energy electromagnetic field that would be impractical. Furthermore, the invention is not limited to the use of electromagnetic fields, and virtually any detectable energy field could be used in place of the electromagnetic fields. For example, ultrasonic generators could be positioned to generate generated detectable acoustic fields, or magnets could be positioned to generate detectable magnetic fields. The term RF is therefore considered herein to also include electromagnetic fields.

Most cooking appliances have one or more region or zone where food products are positioned for cooking. The RFID antennae or scanner is preferably positioned and configured to read RFID tags disposed on packaging that contains the food product, such as a pre-packaged ready-to-eat meal. Alternatively, the antennae or scanner may be more localized, such that the RFID tag is detected from a different position, such as a well-marked read area. For example, the RFID tag, whether or not secured to the food product package, may be disposed in a read area in order to communicate the cooking instructions to the cooking appliance. An audible and visual alert may be electronically provided to guide the customer in positioning the RFID tag or confirming a successful reading of the RFID tag. Redundant RFID scanners may be provided to increase reliability of the data collected.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, or device. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain or store the program for use by or in connection with the instruction execution system, apparatus, or device. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method comprising:

using an RFID antennae of a cooking appliance to read a plurality of cooking instruction sets from an RFID tag associated with a food product that is positioned to be cooked by the cooking appliance, wherein each cooking instruction set includes a cooking appliance performance parameter value necessary to perform the cooking instruction set;

reading a performance parameter rating of the cooking appliance from a memory device of the cooking appliance; and automatically selecting one of the plurality of cooking instruction sets that the cooking appliance is capable of performing, wherein the cooking appliance is capable of performing one of the plurality of cooking instructions sets if the performance parameter rating of the cooking appliance is determined to be greater than or equal to the performance parameter value of the cooking instruction set; and cooking the food product by controlling the cooking appliance according to the selected cooking instruction set.

2. The method of claim 1, wherein the RFID tag is secured to packaging that holds the food product.

3. The method of claim 2, further comprising:

using the RFID antennae of the cooking appliance to read a temperature of the food product; and adjusting the set of cooking instructions based upon the temperature of the food product.

4. The method of claim 3, wherein the temperature of the food product is read prior to cooking the food product.

5. The method of claim 1, wherein the cooking instructions include properties of the food product, the method further comprising:

automatically calculating one or more cooking appliance settings to cook the food product based upon the properties of the food product.

6. The method of claim 5, wherein the cooking appliance is a microwave oven and the one or more cooking appliance settings include a power level and a duration.

7. The method of claim 6, further comprising:

the cooking appliance displaying information about the selected cooking instruction set for viewing by a user; and the cooking appliance beginning the cooking step upon detecting user confirmation on of the displayed information.

8. The method of claim 1, further comprising:

the cooking appliance displaying information about the selected cooking instruction set for viewing by a user; and the cooking appliance beginning the cooking step upon detecting user confirmation of the displayed information.

9. The method of claim 1, wherein the cooking appliance is an oven, the method further comprising:

the oven beginning the cooking step upon detecting that a door of the oven has been closed with the food product inside.

10. The method of claim 1, further comprising:

detaching the RFD tag from packaging around the food product prior to cooking the food product.

11. A method comprising:

using an RFID antennae of a cooking appliance to read a plurality of cooking instruction sets from an RFID tag associated with a food product that is positioned to be cooked by the cooking appliance;

using the REID antennae of the cooking appliance to read a temperature of the food product;

determining whether the food product is frozen or not frozen;

automatically selecting a first cooking instruction set from the plurality of cooking instruction sets in response to determining that the food product is frozen;

automatically selecting a second cooking instruction set from the plurality of cooking instructions sets in response to determining that the food product is not frozen, wherein the cooking appliance is capable of performing either of the first and second cooking instruction sets; and cooking the food product by controlling the cooking appliance according to the selected cooking instruction set.

* * * * *